US005667661A

United States Patent [19]

Hughes

[11] Patent Number: 5,667,661

[45] Date of Patent: Sep. 16, 1997

[54] WIRE PLATING

[75] Inventor: Andrew Hughes, Scotland, United Kingdom

[73] Assignee: United Wire Limited, Edinburgh, Scotland

[21] Appl. No.: 545,655

[22] PCT Filed: Sep. 13, 1993

[86] PCT No.: PCT/GB93/01933

§ 371 Date: Oct. 31, 1995

§ 102(e) Date: Oct. 31, 1995

[87] PCT Pub. No.: WO94/26435

PCT Pub. Date: Nov. 24, 1994

[30] Foreign Application Priority Data

May 8, 1995 [GB] United Kingdom ..... 9309521

[51] Int. Cl.[6] ..... C25D 7/06; C25D 5/10; C25D 5/52; C25D 17/00

[52] U.S. Cl. ..... 205/138; 205/152; 205/170; 205/210; 205/222; 204/209

[58] Field of Search ..... 205/138, 152, 205/170, 210, 222; 204/209; 428/607, 642, 674, 935

[56] References Cited

U.S. PATENT DOCUMENTS

| | | | |
|---|---|---|---|
| 2,580,801 | 1/1952 | Leonard | 205/222 |
| 3,920,409 | 11/1975 | Taniguchi | 205/138 |
| 4,952,249 | 8/1990 | Dambre | 205/210 |

FOREIGN PATENT DOCUMENTS 53-101686 9/1978 Japan .

*Primary Examiner*—Kathryn L. Gorgos
*Assistant Examiner*—Edna Wong
*Attorney, Agent, or Firm*—Lee, Mann, Smith, McWilliams, Sweeney & Ohlson

[57] ABSTRACT

In a method of continuously coating a conductive substrate such as brass wire to produce a desired cross-sectional size of coated material, the wire is drawn through a first die to produce an oversize wire, electroplate in a bath, and then drawn through a final die to reduce its area to the desired size and produce a controlled surface finish. The wire may be cleaned in an acid bath and rinsed in a rinsing bath prior to the electroplating bath. A further rinsing bath and dryer may be interposed upstream of the final die.

15 Claims, 1 Drawing Sheet

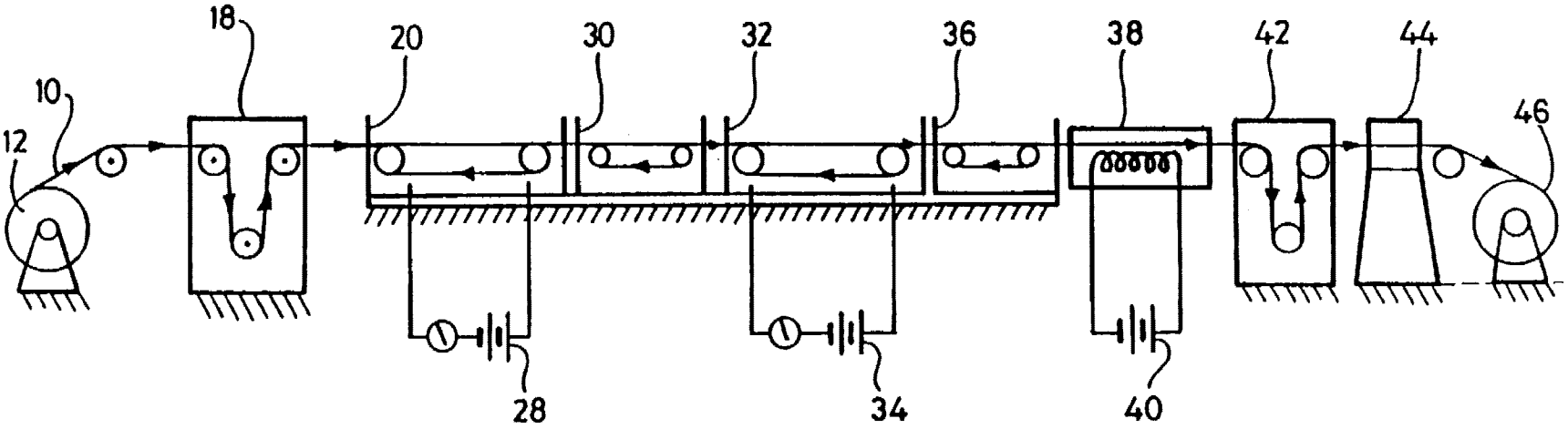
46
44
42
38
40
36
34
32
30
28
20
18
10
12

WIRE PLATING

This is a national stage application of PCT/GB93/01933 filed Sep. 13, 1993.

FIELD OF INVENTION

This invention concerns apparatus and method by which an elongate substrate can be continuously coated, and the elongate material when so produced. The invention is of particular application to the coating or plating of metal typically in the form of wire or tape to achieve a coated material having a desired overall cross-sectional size and temper.

BACKGROUND TO THE INVENTION

For many applications wire or tape must be plated on its external surface such as for protection or insulation. Where the overall cross-sectional size of the coated or plated material does not have to be held to a high tolerance, known processes may be employed.

Difficulties arise where continuous plating has to achieve a particular overall cross-sectional size for the end product and the invention is of particular importance in such processes.

It is therefore a primary object of the present invention to provide a method and apparatus for plating in a continuous manner a conductive substrate typically in the form of wire or tape and typically of metal so as to enable a final predictable and accurately controlled cross-section size of the plated material to be obtained.

It is a subsidiary object of the invention to provide apparatus and method by which continuously produced plated wire or tape has not only a controlled cross-sectional size but also a controlled surface finish.

SUMMARY OF THE INVENTION

According to one aspect of the present invention a method of continuously coating a conductive substrate so as to achieve a desired overall cross-sectional size of the coated material comprises the steps of:

(a) drawing the material through at least one die so as to produce a cross-sectional size which is somewhat greater than that desired in the end product;

(b) electro plating the substrate material in a continuous manner as it passes through an electro plating bath; and (c) drawing the plated substrate through a final die to reduce the cross-sectional area to the desired size.

Preferably the surface of the substrate material is cleaned prior to the electro plating step using acid or alkaline washes as appropriate.

Preferably the plated material is rinsed and dried after it is passed through the electro plating bath and before it is drawn, so as to remove any plating bath materials from the surface of the plated substrate.

Preferably the first mentioned drawing step is followed by a stress relieving step.

Preferably the plated substrate material is heated and dried after rinsing and prior to passing through the final die.

Where the substrate is a metal typically a metal alloy, the reduction in size effected by the final die is also arranged to introduce the desired temper into the metal substrate as a result of the drawing through the die.

It will be found that in general the drawing of the plated material through the final die will result in a more uniform thickness of plated material over the substrate and an improvement in the surface finish or smoothness of the plated surface. This is particularly so where high current density has to be employed in order to achieve rapid plating as the substrate passes through the electro plating bath.

Where two or more materials are to be plated on the original substrate one above the other, the substrate may be passed through second and subsequent electro plating baths with appropriate rinsing and washing stations between each bath in manner known per se.

Additionally the invention envisages the use of two or more electro plating baths each plating the same material onto material passing therethrough, thereby enabling a greater thickness of the plating material to be applied to the original substrate than would be possible by passing the substrate through a single plating bath. In this arrangement the baths are arranged in series so that the material passes from one to the next in sequence with or without rinsing between baths as appropriate.

The invention also lies in apparatus for performing the aforementioned method comprising at least one die through which elongate substrate material in a continuous length can be drawn to achieve a first overall cross-sectional size, electro plating means through which the drawn material passes for electro plating on the surface thereof at least one material, and a final die drawing means through which the coated substrate material is drawn to achieve the finally desired cross-sectional area of the plated material.

Stress relieving means may be included after the first mentioned die drawing means.

The apparatus may also include a cleaning bath situated between the incoming wire and the electro plating apparatus, for surface cleaning of the substrate.

The apparatus may also include rinsing and washing baths between the plating apparatus and the final die.

Heating and drying apparatus is advantageously included after the rinsing and washing stage and the final die.

The invention further extends to coated elongate material when produced by the method or apparatus as stated above.

According to another aspect of the present invention there is provided a coated elongate material comprising a conductive substrate formed by drawing through at least one die, the substrate having a coating thereon produced by electroplating, and the resultant plated substrate being formed to its desired cross-sectional area by being drawn through a final sizing die.

The invention is of particular application in the coating of alloys such as brass and the process has been used to coat a brass wire with Indium. Thus in one example brass wire of 1.46 mm diameter was coated with Indium to a depth of 0.5 to 1.0 microns by passing it through an electro plating bath containing Indium Sulphamate 60% solution and Indium ingots with a direct current of 85 amps. Coating to the depth indicated was achieved at speeds of the order of 60 meters per minute.

The final die not only reduced the diameter to 1.39 mm but improved the surface finish of the plated brass and also improved the temper of the brass enabling the latter to be formed into pins.

The surface finish achieved by the final die also enabled the plated brass to be shaped by metal forming processes so as to provide an enlarged diameter head at one end of a section housing a slightly smaller diameter than the head but still greater than the diameter of the remainder of the pin.

The final die drawing stage did not disturb the plating and produced a surface finish and tempered product which was not only capable of being formed as aforesaid but constructed to a high tolerance.

The method and apparatus has also been employed to plate lead onto brass wire to a similar depth.

The invention will now be described by way of example, with reference to the accompanying drawing which illustrates diagrammatically apparatus for performing the method of the invention.

BRIEF DESCRIPTION OF THE DRAWING

The single FIGURE shows the method of continuously coating a conductive substrate according to the invention.

DETAILED DESCRIPTION OF DRAWINGS

In the drawing the brass wire (10) produced through a series of dies and wound onto a large reel (12) is then mounted on a let-off unit (14) and passed into the plating equipment. Within the plating equipment, the wire is passed through a tensioning stage (18) after which it passes through a cleaning bath (20) containing an acid solution supplied with current from an adjustable DC source (28) and thereafter a rinsing bath (30). The wire then passes into the plating bath (32) supplied with current from an adjustable DC source (34). Both the cleaning and plating currents are indicated by ammeters, and controls are provided in manner known per se to adjust the currents to suit conditions.

After plating, the wire passes through a rinsing bath (36) after which is passes through a dryer (38) containing an electrically powered heater (40), after which it passes through a tensioning device (42), before passing into the final die drawing apparatus (44).

The final die is adjusted to reduce the cross-sectional area of the plated material to 1.39 mm. After drawing through the final die the finished material is wound up on a take-up reel (46) driven by motor means (not shown).

The electro-plating bath (32) contains a salt of the metal which is to be coated on the brass wire, and in the case of Indium the material is preferably Indium Sulphamate.

I claim:

1. A method for the production of surface treated, metal alloy pins of a preselected overall cross-sectional size, which comprises continuously coating a conductive metal alloy substrate by the steps of:

a) drawing the metal alloy substrate through at least one die so as to produce a cross-sectional size which is greater than that desired for the pins;

b) stress relieving the drawn alloy;

c) electroplating the drawn, metal alloy substrate to a thickness not exceeding approximately 1 micron in a continuous manner as it passes through an electroplating bath;

d) drawing the plated, metal alloy substrate through a final die to reduce the cross-sectional area to the predetermined pin size; and e) forming the pins.

2. A method according to claim 1 in which the surface of the metal alloy substrate is cleaned prior to the electroplating step using acid or alkaline washes.

3. A method according to claim 1 in which the plated, metal alloy substrate is rinsed and dried after it is passed through the electroplating bath and before it is drawn through the final die, so as to remove any plating bath materials from the surface of the plated substrate.

4. A method according to claim 3 in which the plated substrate material is heated and dried after rinsing and prior to being drawn through the final die.

5. A method according to claim 1 in which the metal alloy substrate is a brass substrate, and in which the reduction in size effected by the final die is also arranged to introduce the desired temper into the substrate as a result of the drawing through the die.

6. A method according to claim 1 in which two or more materials are plated on the metal alloy substrate one above the other, the substrate being passed through second and subsequent electroplating baths with appropriate rinsing and washing stations between each bath.

7. A method according to claim 1 using two or more electroplating baths arranged in series, each plating the same material onto the metal alloy substrate passing therethrough.

8. A method according to claim 1 in which the step of drawing the plated, metal alloy substrate through the final die also controls the surface finish required for the pins.

9. A method according to claim 1 in which the electroplating is carried out at a speed of approximately 60 meters per minute.

10. A method as claimed in claim 1 in which the substrate is a brass wire coated with indium.

11. A method as claimed in claim 1 in which two or more materials are plated on the substrate one above the other.

12. Apparatus for producing surface treated, metal alloy pins comprising at least one die drawing means through which an elongate, metal alloy substrate in a continuous length can be drawn to achieve a first overall cross-sectional size, stress relieving means located after the first mentioned die drawing means, electroplating means through which the stress relieved drawn substrate passes for electroplating on the surface thereof, a final die drawing means through which the plated substrate is drawn to achieve a preselected cross-sectional area of the pins, and means for forming the pins, when operated to produce pins electroplated to a thickness not exceeding approximately 1 micron before the final die drawing means.

13. Apparatus according to claim 12 further comprising means including a cleaning bath situated between the incoming elongate substrate and the electroplating means, for surface cleaning of the substrate.

14. Apparatus according to claim 12 further comprising-means including rinsing and washing baths situated between the electroplating means and the final die means.

15. Apparatus according to claim 12 further comprising heating and drying means located between the rinsing and washing baths and the final die means.

* * * * *